US010532234B2

(12) United States Patent
Hsu

(10) Patent No.: US 10,532,234 B2
(45) Date of Patent: Jan. 14, 2020

(54) FALL ARREST LANYARD WITH RESTRAINT RELIEF ARRANGEMENT

(71) Applicant: Frank C Hsu, Chino, CA (US)

(72) Inventor: Frank C Hsu, Chino, CA (US)

( * ) Notice: Subject to any disclaimer, the term of this patent is extended or adjusted under 35 U.S.C. 154(b) by 115 days.

(21) Appl. No.: 15/832,445

(22) Filed: Dec. 5, 2017

(65) Prior Publication Data

US 2019/0168032 A1 Jun. 6, 2019

(51) Int. Cl.
*A47L 3/04* (2006.01)
*A62B 35/00* (2006.01)

(52) U.S. Cl.
CPC ..... *A62B 35/0043* (2013.01); *A62B 35/0037* (2013.01)

(58) Field of Classification Search
CPC .. A47L 3/04; A62B 1/16; A62B 35/00; A62B 29/02; E06C 7/18; E06C 5/34; E06C 5/44
USPC ..... 182/3, 18
See application file for complete search history.

(56) References Cited

U.S. PATENT DOCUMENTS 3,444,957 A * 5/1969 Ervin, Jr. ..... A62B 35/04 182/3
3,804,698 A * 4/1974 Kinloch ..... B60R 22/28 156/702
4,446,944 A * 5/1984 Forrest ..... A62B 35/04 182/3
4,538,702 A * 9/1985 Wolner ..... A62B 35/04 182/230
5,174,410 A * 12/1992 Casebolt ..... A62B 35/04 182/3
5,287,943 A * 2/1994 Bell ..... A62B 35/04 182/3
5,329,884 A * 7/1994 Bell ..... A62B 35/0018 119/857
5,598,900 A * 2/1997 O'Rourke ..... A62B 35/0056 182/18
5,927,431 A * 7/1999 Klein, Jr. ..... A62B 1/18 182/3
6,533,066 B1 * 3/2003 O'Dell ..... A62B 35/04 182/3
8,360,202 B1 * 1/2013 Woodard ..... A62B 1/16 182/3
8,584,799 B1 * 11/2013 Dennington ..... A62B 35/04 182/3
D732,379 S * 6/2015 Gipson ..... D8/382
(Continued)

FOREIGN PATENT DOCUMENTS

GB 2191560 A * 12/1987 ..... A62B 35/04

*Primary Examiner* — Jerry E Redman
(74) *Attorney, Agent, or Firm* — Tsz Lung Yeung

(57) ABSTRACT

A fall arrest lanyard includes a strap body having a fastening end, a securing end, and a relief portion, and restraint relief arrangement being actuated between a normal operated condition and a relief condition. The restraint relief arrangement includes first and second connectors spacedly affixed at the strap body to define the relief portion thereof between the first and second connectors. At the normal operated condition, the second connector is detachably connected to the first connector to shorten a length of the relief portion of the strap body. At the relief condition, the second connector is detached from the first connector, so that the relief portion is able to be fully extended to create a relief length for allowing the user to escape restraint when the user is restrained by the strap body.

15 Claims, 5 Drawing Sheets

(56) References Cited

U.S. PATENT DOCUMENTS

| | | | | |
|---|---|---|---|---|
| 9,144,711 | B2 * | 9/2015 | Walker | A62B 1/16 |
| 9,656,836 | B2 * | 5/2017 | Unger | B66C 1/18 |
| 10,125,837 | B1 * | 11/2018 | Fegley | F16F 7/006 |
| 2006/0048998 | A1 * | 3/2006 | Wolner | A62B 35/0006 182/3 |
| 2007/0209868 | A1 * | 9/2007 | Betcher | A62B 35/0025 182/3 |
| 2008/0060872 | A1 * | 3/2008 | Wise | A62B 35/0075 182/3 |
| 2010/0252361 | A1 * | 10/2010 | Wood | A62B 1/14 182/6 |
| 2012/0067666 | A1 * | 3/2012 | Smith | A62B 35/04 182/3 |
| 2013/0292219 | A1 * | 11/2013 | Perner | A62B 35/04 188/376 |
| 2014/0224580 | A1 * | 8/2014 | Casebolt | A62B 35/0025 182/3 |
| 2014/0251722 | A1 * | 9/2014 | Schurian | A62B 35/0075 182/3 |
| 2017/0319907 | A1 * | 11/2017 | Crawford | A62B 35/0037 |
| 2018/0161606 | A1 * | 6/2018 | Quigley | A62B 1/16 |

* cited by examiner

FALL ARREST LANYARD WITH RESTRAINT RELIEF ARRANGEMENT

BACKGROUND OF THE PRESENT INVENTION

Field of Invention

The present invention relates to fall protection equipment, and more particularly to a fall arrest lanyard comprising a restraint relief arrangement which is capable of providing an additional relief length of the fall arrest lanyard so as to reduce or eliminate the possibilities of users harming themselves with tangled lanyards.

Description of Related Arts

Safety devices, such as safety harnesses, waist belts or other fall prevention devices, are generally required for users working in elevated positions. In addition, sports enthusiasts, such as rock climbers or zip liners, may also wear these safety devices during such endeavors. Generally, a user may wear a safety harness which is then secured to a lanyard, wherein the lanyard is attached to an anchorage point.

Conventionally, most lanyards only provide some sorts of shock absorbing systems for providing the necessary resistance to decelerate user's fall when necessary. However, one of the greatest dangers to working or playing at heights and falling is that the user may be restrained by the lanyard, which can be the subject of tangling. For example, a falling user may suspend in the air after he fell. He may be accidentally choked or tied around his neck or any parts of his body by the lanyard. Thus, the wrapping of the falling user caused by the sudden tautness in the lanyard may result in serious bodily injury, such as serious choking. Once the user is tangled by the lanyard while he is suspended in the air, the user must be strong enough to pull and hold himself up via the lanyard in order to create enough space from the lanyard. When the user does not have the strength to do all these, he may actually be harmed by the lanyard itself—a safety device originally designed to save the user from falling.

As a result, there is a need to provide a lanyard which allow a user to escape restraints easily when he is restrained by the lanyard while being suspended in the air.

SUMMARY OF THE PRESENT INVENTION

Certain variations of the present invention provide a fall arrest lanyard comprising a restraint relief arrangement which is capable of providing an additional relief length of the fall arrest lanyard so as to reduce or eliminate the possibilities of users harming themselves with tangled lanyards.

Certain variations of the present invention provide a fall arrest lanyard comprising a restraint relief arrangement in which a strap body has a relief portion adapted to be fully extended to create a relief length for allowing the user to escape restraint when the user is restrained by the strap body.

Certain variations of the present invention provide a fall arrest lanyard comprising a restraint relief arrangement in which at a normal operated condition of the fall arrest lanyard, the relief portion of the strap body is folded and locked to shorten the length of the strap body, wherein at a relief condition, a user may actuate the restraint relief arrangement to fully extend the relief portion of the strap body.

Certain variations of the present invention provide a fall arrest lanyard comprising a restraint relief arrangement which permits a user to quickly and easily operate the restraint relief arrangement by pulling the hand pulling strap to extend the relief portion of the strap body.

In one aspect of the present invention, it provides a fall arrest lanyard, comprising:

a strap body having a fastening end adapted for fastening to an anchorage point, a securing end adapted for connecting to a harness worn by a user, and a relief portion defined between the fastening end and the securing end; and a restraint relief arrangement, which comprises:

first and second connectors spacedly affixed at the strap body to define the relief portion thereof between the first and second connectors, wherein the second connector is detachably connected to the first connector to shorten a length of the relief portion of the strap body, so that when the second connector is detached from the first connector, the relief portion is able to be fully extended to create a relief length for allowing the user to escape restraint when the user is restrained by the strap body.

This summary presented above is provided merely to introduce certain concepts and not to identify any key or essential features of the claimed subject matter.

DETAILED DESCRIPTION OF THE PREFERRED EMBODIMENT

Figure 1:
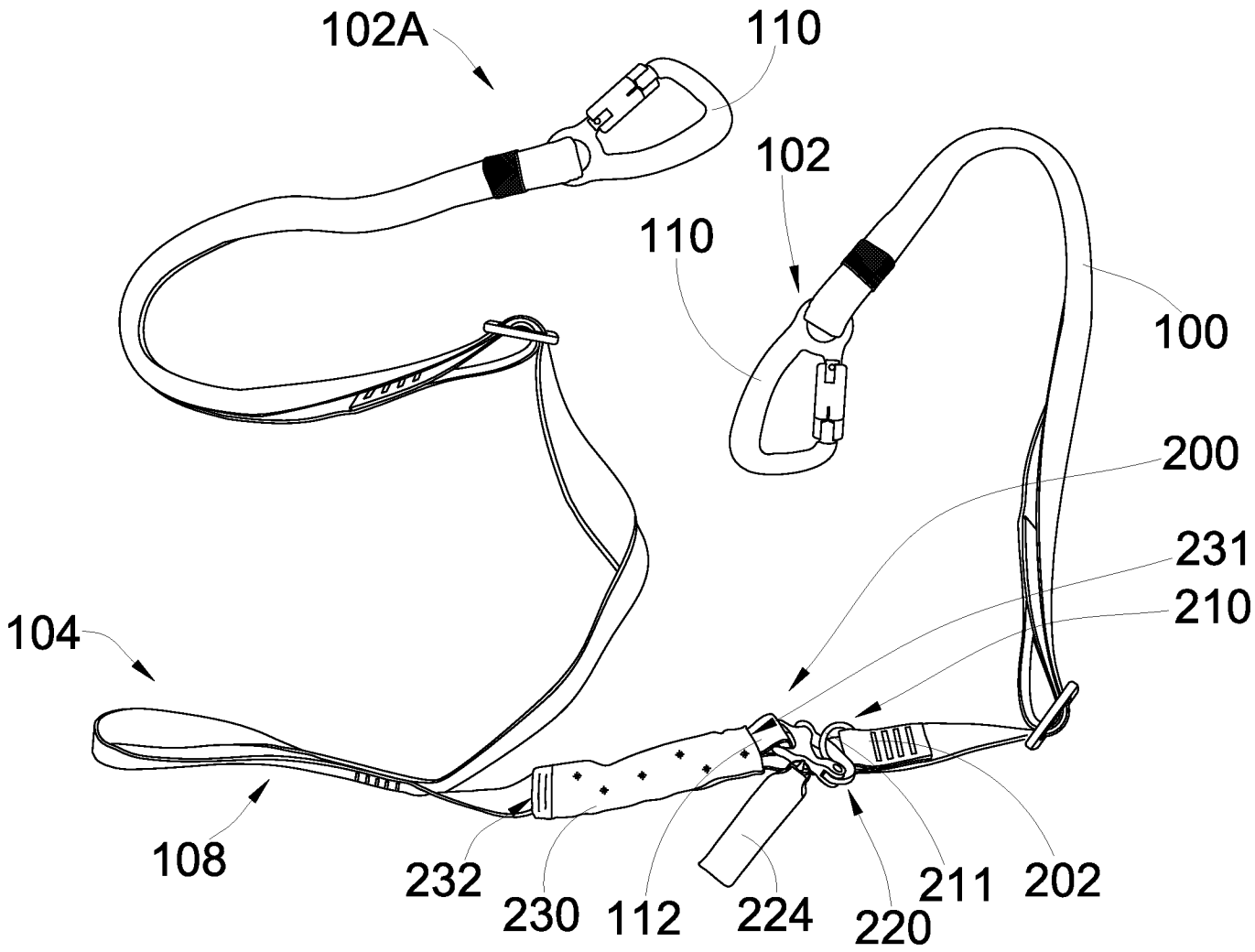
FIG. 1 is a perspective view of a fall arrest lanyard with a restraint relief arrangement according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 5 of the drawings, a fall arrest lanyard according a preferred embodiment of the present invention is illustrated. Broadly, the fall arrest lanyard may comprise a strap body 100, and a restraint relief arrangement 200. The fall arrest lanyard may be used to fasten between an anchorage point and a harness worn by a user. Accordingly, the harness can be a full body harness or a waist belt.

The strap body 100 may have a fastening end 102 adapted for fastening to an anchorage point, a securing end 104 adapted for connecting to a harness worn by a user, and a relief portion 106 provided between the fastening end 102 and the securing end 104.

The restraint relief arrangement 200 may comprise a first connector 210 and a second connector 220 spacedly affixed at the strap body 100 to define a length of the relief portion 106 thereof between the first and second connectors 210, 220, wherein the second connector 220 may be detachably connected to the first connector 210 to normally shorten a length of the relief portion 106 of the strap body 100, so that when the second connector 220 is detached from the first connector 210, the relief portion 106 is able to be fully extended to create a relief length for allowing the user to escape restraint when the user is restrained by the strap body 100.

According to the preferred embodiment of the present invention, the strap body 100 may be made of high strength and non-stretchable material. The fastening end 102 of the strap body 100 may be arranged to fasten to the anchorage point by providing a spring loaded clasp 110 fixedly secured at the fastening end 102 of the strap body 100. The securing end 104 of the strap body 100 may be arranged to connect to the harness worn by the user. A loop portion of the strap body 100 may be folded as a loop sewn section 108 to form a loop, wherein the securing end 104 of the strap body 100 may be provided at the loop sewn section 108 to connect to the harness via any conventional clasp. The loop portion of the strap body 100 may be defined as a portion formed by twisting 180 degrees and overlappedly folding the portion of the strap body 100 to form the loop so as to ensure the loop being retained at an "always opened" condition.

The strap body 100 may further have a secondary fastening end 102A arranged to fasten to a secondary anchorage point by providing another spring loaded clasp 110 fixedly secured at the secondary fastening end 102A of the strap body 100, wherein the securing end 104 of the strap body 100 may be located between the two fastening ends 102 and 102A, so that the strap body as a whole forms a three-point safety device. It should be appreciated that the two fastening ends 102 and 102A of the strap body 100 may be fastened to the same anchorage point.

The restraint relief arrangement 200 may be actuated by the user and may operate between a normal operated condition and a relief condition. FIG. 1 illustrates that the fall arrest lanyard at the normal operated condition. At the normal operated condition, the strap body 100 may be fastened between the harness and the anchorage point, wherein the strap body 100 may have no tension between the fastening end 102 and the securing end 104. When the user falls from an elevated position in a suspended manner, the tension is applied to the strap body 100 by the user's weight between the fastening end 102 (102A) and securing end 104. For example, the strap body 100 may wrap around the user's neck, which may result in serious bodily injury, such as choking.

Figure 2:
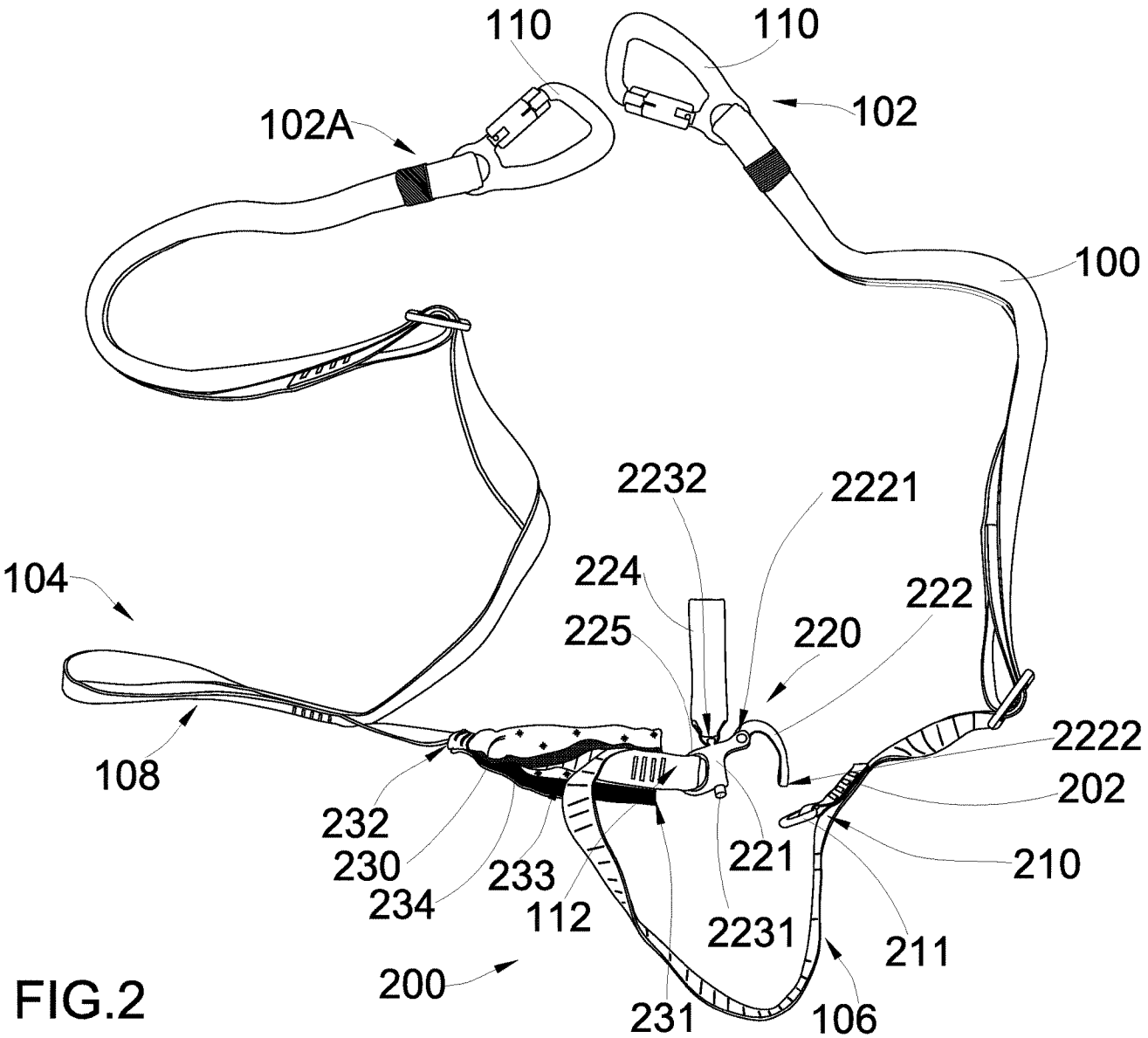
FIG. 2 is a perspective view of the restraint relief arrangement of the fall arrest lanyard at a normal operated condition according to the preferred embodiment of the present invention.
Figure 3:
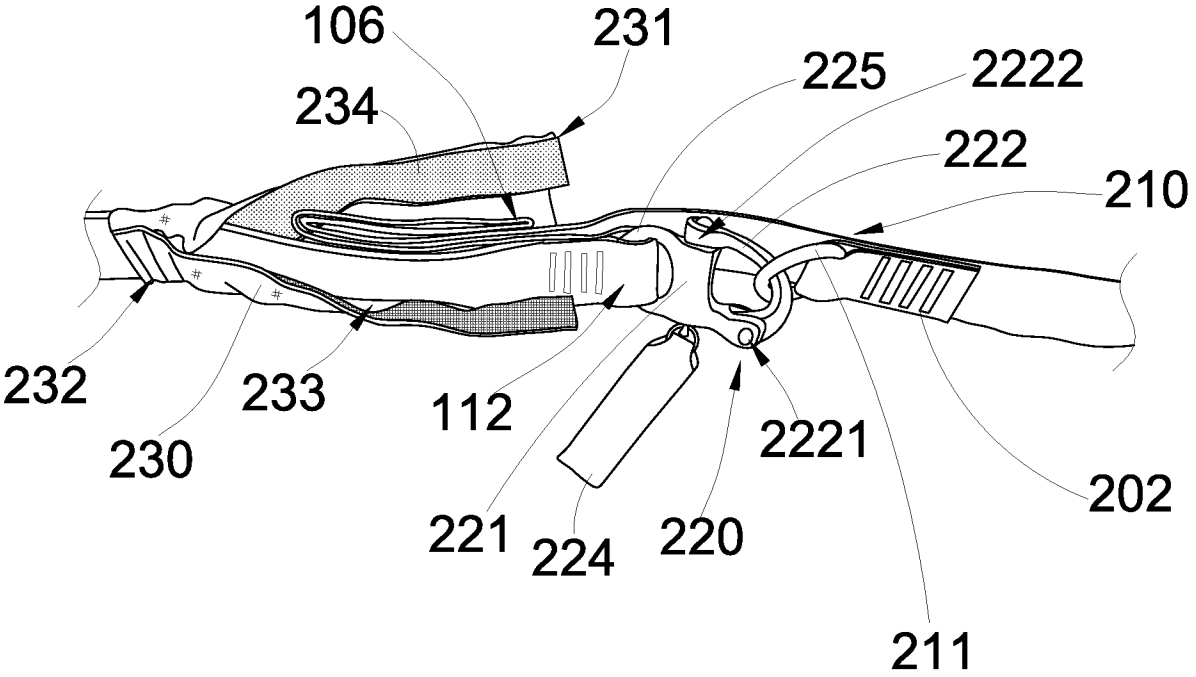
FIG. 3 is a perspective view of the restraint relief arrangement of the fall arrest lanyard at a relief condition according to the preferred embodiment of the present invention.

FIG. 1 to FIG. 3 illustrate the restraint relief arrangement 200. The restraint relief arrangement 200 may comprise first and second connectors 210 and 220 spacedly affixed to the strap body 100, wherein the relief portion 106 thereof may be provided between the first and second connectors 210 and 220. FIG. 1 depicts that when the fall arrest lanyard is at the normal operated condition, the second connector 220 may be detachably connected to the first connector 210 to shorten a length of the relief portion 106 of the strap body 100. FIG. 2 illustrates that when the fall arrest lanyard is at the relief condition, the second connector 220 may be detached from the first connector 210, so that the relief portion 106 of the strap body 100 may be able to fully extend to create a relief length for allowing the user to escape restraint when the user is restrained by the strap body 100.

Referring to FIG. 2 to FIG. 3 of the drawings, the first connector 210 may comprise a connecting ring 211 affixed at one end of the relief portion 106 of the strap body 100. A ring holding leaf 202 may be overlapped and folded to form a ring loop, wherein the connecting ring 211 may be held by the ring loop of the ring holding leaf 202 which may be sewn on the strap body 100, so that the connecting ring 211 may be affixed to the strap body 100 via the ring holding leaf 202. The connecting ring 211 may be configured as a D-ring.

The second connector 220 may be affixed at an opposed end of the relief portion 106 of the strap body 100 to detachably couple to the connecting ring 211. In the preferred embodiment of the preferred embodiment, the second connector 220 may comprise a tubular body 221, a loop clipper 222, and a clip locker 223. The tubular body 221 may have an elongated configuration to define two opening ends. The loop clipper 222 may have a pivot end 2221 pivotally coupled at the tubular body 221 and a clipping end 2222 arranged to engage with the tubular tube 221. When the pivot end 2221 of the loop clipper 222 is pivotally folded to move the clipping end 2222 to engage with the tubular tube 221, a closed loop may be formed by the tubular body 221 and the loop clipper 22, so that the connecting ring 211 may be engaged with the closed loop to connect the second connector 220 with the first connector 210.

The clip locker 223 may be movably coupled to the tubular body 221 between a locked position and an unlocked position. At the locked position, the clipping end 2222 of the loop clipper 222 may be locked by the clip locker 223 to engage with the tubular tube 221 so as to form the closed loop. At the unlocked position, the clipping end 2222 of the loop clipper 222 may be disengaged from the tubular tube 221, so that the loop clipper 222 may be free to pivotally move from the tubular tube 221.

The second connector 220 may further comprise a resilient element 226 mounted on the clip locker 223 within the tubular body 221 for normally exerting a biasing force against the clip locker 223 so as to normally retain the clip locker 223 in the locked position.

Figure 4:
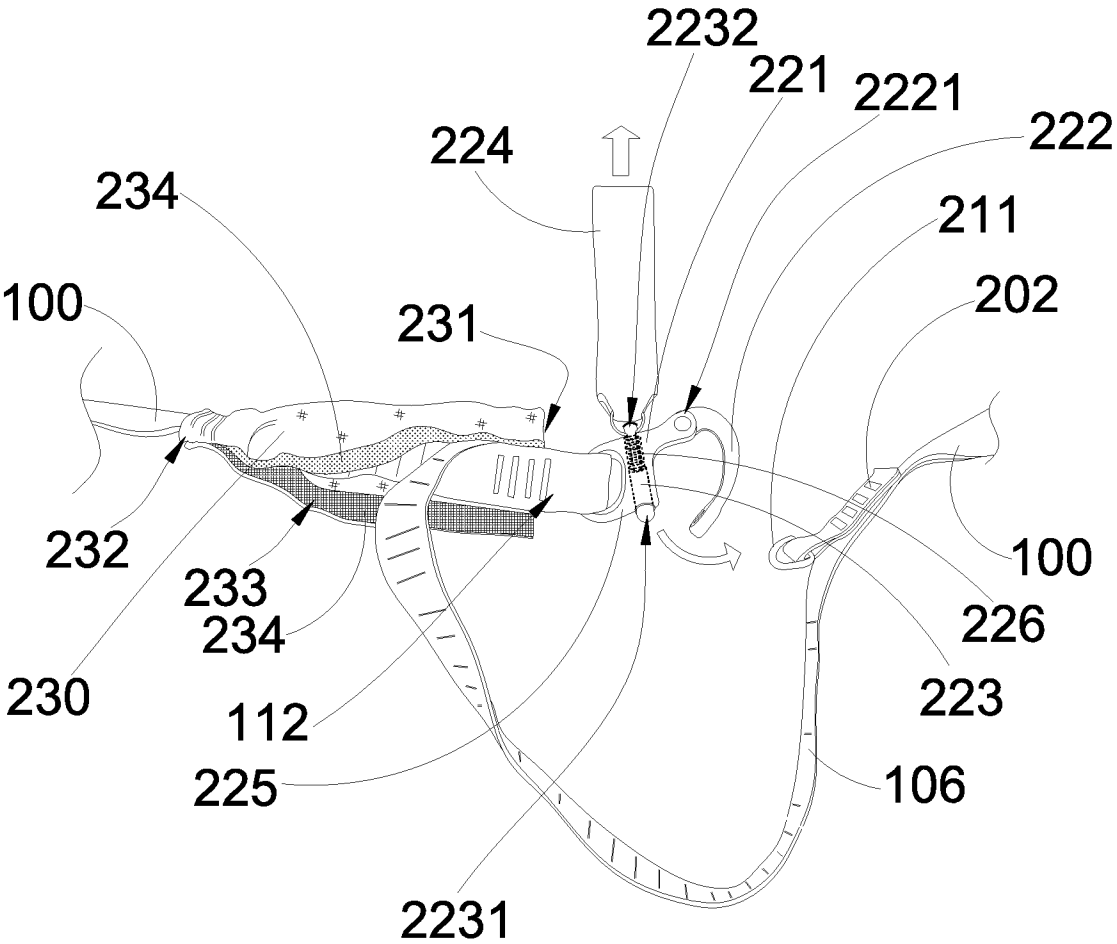
FIG. 4 is a schematic diagram of the restraint relief arrangement of the fall arrest lanyard according to the preferred embodiment of the present invention, illustrating the operation of the second connector.
Figure 5:
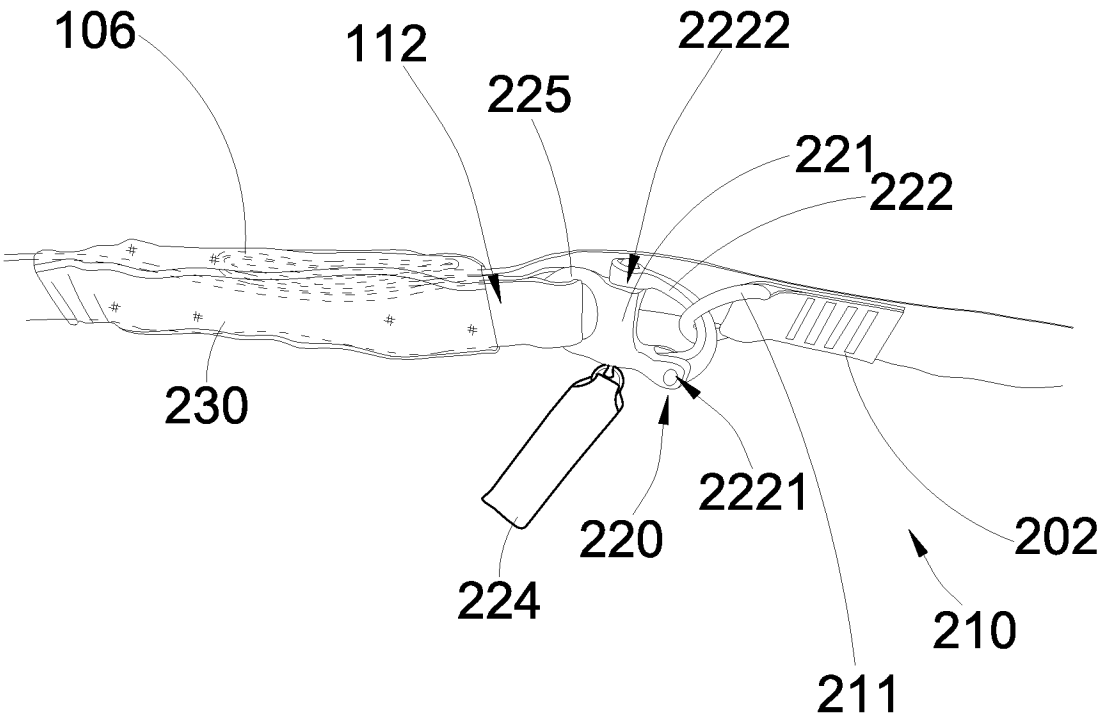
FIG. 5 is a schematic diagram of the relief portion of the fall arrest lanyard at a normal operated condition according to the preferred embodiment of the present invention, illustrating the relief portion being folded and received in the sleeve pocket.

Referring to FIG. 3 to FIG. 4 of the drawings, the clip locker 223 may be configured as a spring-loaded actuator slidably coupled along the tubular body 221 in a retractable manner, wherein the clip locker 223 may have a locking end 2231 and an opposed actuating end 2232. A length of the clip locker 223 between the locking end 2231 and the actuating end 2232 may be longer than a length of the tubular body 221 between the two openings ends thereof. The locking end 2231 of the clip locker 223 may be slidably protruded from one opening end of the tubular body 221 to lock the clipping end 2222 of the loop clipper 222, so that the closed loop may be locked and formed by the tubular body 221 and the loop clipper 22.

The actuating end 2232 of the clip locker 223 may be arranged to be pulled along an axis of the tubular body 221 to slidably move and retract the locking end 2231 of the clip locker 223 from the opening end of the tubular body 221. Once the locking end 2231 of the clip locker 223 is pulled back into the opening end of the tubular body 221, the locking end 2231 of the clip locker 223 may be unlocked to release the engagement between the clipping end 2222 of the loop clipper 222 and the tubular tube 221. As a result, the second connector 220 may be detached from the first connector 210.

The tension created by the user's weight may be applied to the strap body 100 except the relief portion 106 so as to pull the first and second connectors 210 and 220 away from each other when the user falls from the elevated position. In other words, when the first and second connectors 210 and 220 are connected with each other, the relief portion 106 of the strap body 100 may not have any significant tension. Once the first and second connectors 210 and 220 are disconnected from each other, the tension may be applied to the relief portion 106 of the strap body 100.

Referring to FIG. 4 of the drawings, in order to ensure the first and second connectors 210 and 220 being disconnected from each other at the relief condition, the loop clipper 222 may be configured in such a manner that a curvature of the loop clipper 222 close to the pivot end 2221 thereof may be larger than a curvature of the loop clipper close 222 to the clipping end 2222. It may be ensured that the clipping end 2222 of the loop clipper 222 is disengaged with the tubular body 221 when the actuating end 2232 of the clip locker 223 is pulled. That is, by unlocking the clipping end 2222 of the loop clipper 222, the opposed forces exerted at the first and second connectors 210 and 220 may pull the connecting ring 211 to slide along an inner side of the loop clipper 222 toward the clipping end 2222 thereof. By configuring different curvatures of the loop clipper 222, the loop clipper 222 may be pivotally pulled at the pivot end 2221 thereof by the connecting ring 211 so as to ensure the clipping end 2222 of the loop clipper 222 being moved away from the tubular body 211. As a result, the connecting ring 211 may be disengaged from the loop clipper 222 so as to disengage the second connector 220 from the first connector 210.

The second connector 220 may further comprise a hand pulling strap 224 coupled at the actuating end 2232 of the clip locker 223 to drive the locking end 2231 thereof to move. When the user pulls the hand pulling strap 224, the locking end 2231 of the clip locker 223 may be pulled to retract into the opening end of the tubular body 221, so as to unlock the second connector 220 with the first connect 210. Once the pulling force of the user is released from the hand pulling strap 224, the clip locker 223 may be returned by its own spring to its original position and the locking end 2231 of the clip locker 223 may slidably protrude from the opening end of the tubular body 221. Therefore, the user may quickly and easily operate the restraint relief arrangement 200 by pulling the hand pulling strap 224 to extend the relief portion 106 of the strap body 100.

The second connector 220 may further comprise a strap ring 225 extended from the tubular body 221. According to the preferred embodiment, the strap ring 225 may be integrally extended from the tubular body 221 such that the strap ring 225 and the loop clipper 222 may be extended from the tubular body 221 in opposite directions. In addition, the strap body 100 may further have an overlapped sewn section 112 affixed to the strap ring 225, wherein the overlapped sewn section 112 of the strap body 100 may be a portion formed by overlapping and sewing the portion of the strap body 100 to form a loop for the strap ring 225 affixing thereto.

Referring to FIG. 2 to FIG. 5 of the drawings, the restraint relief arrangement 200 may further comprise a sleeve pocket 230 attached to the strap body 100 to receive the relief portion 106 thereof at the normal operated condition when the first and second connectors 210 and 220 are coupled with each other. Therefore, the relief portion 106 of the strap body 100 may normally be hidden in the sleeve pocket 230 during the normal operated condition.

The sleeve pocket 230 may be made of a fabric layer which may be tri-folded to have a tubular structure and to affix to the sleeve pocket 230 at position that the second connector 220 is located between the sleeve pocket 230 and the first connector 210. The sleeve pocket 230 may have an opened end 231 facing toward the second connector 220, a closed end 232 attached to the strap body 100 via sewing, and a side opening 233 extended from the opened end 231 toward the closed end 232 to facilitate the relief portion 105 of the strap body 100 being received in the sleeve pocket 230.

The sleeve pocket 230 may further comprise a detachable fastener 234 provided on the sleeve pocket 230 along the side opening 233 to releasably close the side opening 233. It is preferred that the detachable fastener 234 comprises hook-and-loop fasteners affixed along two side edges of the side opening 233 of the sleeve pocket 230, so that the side opening 233 can be closed when the hook-and-loop fasteners are fastened with each other and may be opened when the hook-and-loop fasteners are detached from each other. Once the side opening 233 is opened, the opened end 231 and the side opening 233 may form an enlarged opening to receive the relief portion 106 of the strap body 100.

It should be appreciated that the opened end 231 of the sleeve pocket 230 may always be opened to ensure the relief portion 106 of the strap body 100 to be forced out of the sleeve pocket 230 at the relief condition when the second connector 220 is detached from the first connector 210. In other words, there is no fastener at the opened end 231 of the sleeve pocket 230 so as to maintain the opened end 231 of the sleeve pocket 230 in an opened condition.

It should be appreciated that the relief portion 106 of the strap body 100 may be folded and overlapped to receive in the sleeve pocket 230 in such a way that the relief portion 106 of the strap body 100 is folded in a zigzag configuration to be received in the sleeve pocket 230. Therefore, the relief portion 106 of the strap body 100 may be smoothly pulled out of the sleeve pocket 230 through the opened end 231 thereof once the second connector 220 is detached from the first connector 210 at the relief condition. The side opening 233 of the sleeve pocket 230 may be opened only when the relief portion 106 of the strap body 100 is folded to receive back in the sleeve pocket 230.

Accordingly, the sleeve pocket 230 may have a predetermine length defined between the opened end 231 and the closed end 232. The closed end 232 of the sleeve pocket 230 may be affixed to the strap body 100 at a position that the opened end 231 of the sleeve pocket 230 may be extended and encircled around the overlapped sewn section 112 of the strap body 100. In other words, the overlapped sewn section 112 of the strap body 100 may be located within the opened end 231 of the sleeve pocket 230 at the normal operated condition. For this configuration, the relief portion 106 of the strap body 100 may be received and hidden in the sleeve pocket 230 at the normal operated condition. It is important to hide the relief portion 106 of the strap body 100 in the sleeve pocket 230 at the normal operated condition to prevent any object from clasping the relief portion 106 of the strap body 100 at the normal operated condition.

In order to use the fall arrest lanyard of the present invention, the user may first need wear a harness, such as the full body harness or waist belt, and attach the fastening end 102 and the securing end 104 of the strap body 100 to the anchorage point and the harness respectively. The relief portion 106 of the strap body 100 may be folded and received in the sleeve pocket 230 at the normal operated condition. In the unlikely event that the user falls from an elevated position, the fall arrest lanyard may provide adequate support to hold the user in the air (i.e. in a suspended manner). The user may be wrapped by the strap body 100, or may even be choked by the strap body 100. In this situation, the user may be able to pull the hand pulling strap 224 so as to automatically detach the second connector 232 from the first connector 231. Then, the relief portion 106 of the strap body 100 may be unfolded and pulled out of the sleeve pocket 230 at the relief condition. As a result, the relief portion 106 of the strap body 100 may give additional relief length of the strap body 100 to permit the user to unwrap the strap body 100 so as to untie or even escape restraints through the additional space provided by the fall arrest lanyard of the present invention. Therefore, the restraint relief arrangement 200 of the fall arrest lanyard may also serves as a choke prevention arrangement to permit the user to escape from being choked by the strap body 100. The fall arrest lanyard of the present invention is also reusable because the unfolded relief portion 106 of the strap body 100 may be folded and received back in the sleeve pocket 230.

The manufacturing process of the restraint relief arrangement of the fall arrest lanyard may be designed to be simple and inexpensive. The restraint relief arrangement may be formed by spacedly affixing the first and second connectors 210 and 220 to the strap body 100, and affixing the sleeve pocket 230 to the strap body 100. Therefore, the restraint relief arrangement 200 may be incorporated with any conventional lanyard. It should be appreciated that the fall arrest lanyard of the present invention can be a two-point safety device, wherein the securing end 104 of the strap body 100 can be omitted and replaced by the secondary fastening end 102A thereof. Therefore, the two fastening ends 102 and 102A of the strap body 100 can be attached to the anchorage point and the harness respectively.

The present invention, while illustrated and described in terms of a preferred embodiment and several alternatives, is not limited to the particular description contained in this specification. Additional alternative or equivalent components could also be used to practice the present invention.

What is claimed is:

1. A fall arrest lanyard, comprising:

a strap body having a fastening end adapted for fastening to an anchorage point, a securing end adapted for connecting to a harness worn by a user, and a relief portion defined between said fastening end and said securing end; and a restraint relief arrangement, which comprises:

first and second connectors spacedly affixed at said strap body to define said relief portion thereof between said first and second connectors, wherein said second connector is detachably connected to said first connector to shorten a length of said relief portion of said strap body, so that when said second connector is detached from said first connector, said relief portion is able to be fully extended to create a relief length for allowing the user to escape restraint when the user is restrained by said strap body, said first connector comprising a connecting ring affixed at one end of said relief portion of said strap body, said second connector being affixed at an opposed end of said relief portion of said strap body to detachably couple to said connecting ring, said second connector comprising a tubular body, a loop clipper having a pivot end pivotally coupled at said tubular body and a clipping end arranged to engage with said tubular body to form a loop, and a clip locker slidably coupled along said tubular body to engage with said clipping end of said loop clipper so as to engage said clipping end of said loop clipper with said tubular body, wherein said clip locker, which is a spring-loaded actuator, has a locking end slidably protruded from one end of said tubular body to lock at sad clipping end of said loop clipper and an actuating end being pulled to slidably move said locking end thereof and to unlock said clipping end of said loop clipper, so as to disengage said second connector with said first connector.

2. The fall arrest lanyard of claim 1, wherein a curvature of said loop clipper close to said pivot end thereof is larger than a curvature of said loop clipper close to said clipping end to ensure said clipping end of said loop clipper being disengaged with said tubular body when said actuating end of said clip locker is pulled.

3. The fall arrest lanyard of claim 2, wherein said second connector further comprises a strap ring integrally extended from said tubular body, wherein said strap body has an overlapped sewn section affixed to said strap ring.

4. The fall arrest lanyard of claim 3, wherein said strap body is made of non-stretchable material.

5. The fall arrest lanyard of claim 1, wherein said second connector further comprises a hand pulling strap coupled at said actuating end of said clip locker.

6. A fall arrest lanyard, comprising:

a strap body having a fastening end adapted for fastening to an anchorage point, a securing end adapted for connecting to a harness worn by a user, and a relief portion defined between said fastening end and said securing end; and a restraint relief arrangement, which comprises:

first and second connectors spacedly affixed at said strap body to define said relief portion thereof between said first and second connectors, wherein said second connector is detachably connected to said first connector to shorten a length of said relief portion of said strap body, so that when said second connector is detached from said first connector, said relief portion is able to be fully extended to create a relief length for allowing the user to escape restraint when the user is restrained by said strap body, wherein said restraint relief arrangement further comprises a sleeve pocket attached to said strap body to receive said relief portion thereof when said first and second connectors are coupled with each other, wherein said sleeve pocket, having a tubular shape, has an opened end facing toward said second connector, a closed end attached to said strap body, and a side opening extended from said opened end toward said closed end to facilitate said relief portion of said strap body being received in said sleeve pocket.

7. The fall arrest lanyard of claim 6, wherein said sleeve pocket further comprises a detachable fastener provided along said side opening to releasably close said side opening.

8. The fall arrest lanyard of claim 6, wherein said opened end of said sleeve pocket is always opened to ensure said relief portion of said strap body being forced out of said sleeve pocket when said second connector is detached from said first connector.

9. The fall arrest lanyard of claim 6, wherein said relief portion of said strap body is folded and overlapped to receive in said sleeve pocket.

10. The fall arrest lanyard of claim 6, wherein said relief portion of said strap body is folded in a zigzag configuration to be received in said sleeve pocket.

11. The fall arrest lanyard of claim 6, wherein said relief portion of said strap body is received in said sleeve pocket in a hidden manner when said first and second connectors are connected with each other.

12. The fall arrest lanyard of claim 6, wherein said strap body further has a secondary fastening end adapted for fastening to a secondary anchorage point, so that said strap body forms a three-point safety device.

13. The fall arrest lanyard of claim 12, wherein said strap body has a loop sewn section defining said fastening end thereat, wherein said securing end of said strap body is located between said two fastening ends thereof.

14. The fall arrest lanyard of claim 13, wherein said strap body is made of non-stretchable material.

15. The fall arrest lanyard of claim 6, wherein said strap body is made of non-stretchable material.

* * * * *